US007115175B2

(12) United States Patent
DeLuca et al.

(10) Patent No.: US 7,115,175 B2
(45) Date of Patent: Oct. 3, 2006

(54) MODIFIED ADVANCED HIGH STRENGTH SINGLE CRYSTAL SUPERALLOY COMPOSITION

(75) Inventors: Daniel P. DeLuca, Hebron, CT (US); Charles M. Biondo, Jupiter, FL (US)

(73) Assignee: United Technologies Corporation, Hartford, CT (US)

( * ) Notice: Subject to any disclaimer, the term of this patent is extended or adjusted under 35 U.S.C. 154(b) by 18 days.

(21) Appl. No.: 10/893,849

(22) Filed: Jul. 19, 2004

(65) Prior Publication Data

US 2005/0016641 A1 Jan. 27, 2005

Related U.S. Application Data

(62) Division of application No. 09/943,150, filed on Aug. 30, 2001.

(51) Int. Cl.
*C22F 1/10* (2006.01)
*C22C 19/05* (2006.01)

(52) U.S. Cl. ..... 148/556; 148/675; 148/677; 420/444; 420/448

(58) Field of Classification Search ..... 420/441
See application file for complete search history.

(56) References Cited

U.S. PATENT DOCUMENTS 4,302,256 A 11/1981 Kenton
4,769,087 A 9/1988 Genereux et al.
4,975,124 A * 12/1990 Ault ..... 148/562
5,240,518 A * 8/1993 Wortman et al. ..... 148/404
5,366,695 A * 11/1994 Erickson ..... 420/448
5,489,346 A * 2/1996 Erickson ..... 148/404
5,605,584 A 2/1997 DeLuca et al.
5,725,692 A 3/1998 DeLuca et al.
5,788,785 A 8/1998 DeLuca et al.
6,355,117 B1 3/2002 DeLuca et al.
6,383,448 B1 5/2002 Das
2002/0062886 A1 5/2002 Hino et al.
2002/0124915 A1 9/2002 Kobayashi
2003/0103862 A1* 6/2003 Bouse et al. ..... 420/448

OTHER PUBLICATIONS

U.S. Appl. No. 60/185,696, filed Feb. 29, 2000.*
"Nickel, Cobalt, and Their Alloys", pub. by ASM International, Dec. 2000, p. 302.

* cited by examiner

*Primary Examiner*—Roy King
*Assistant Examiner*—Michael P. Alexander
(74) *Attorney, Agent, or Firm*—Bachman & LaPointe, P.C.

(57) ABSTRACT

The present invention relates to an improved single crystal nickel base superalloy and a process for making same. The single crystal nickel base superalloy has a composition comprising 3 to 12 wt % chromium, up to 3 wt % molybdenum, 3 to 10 wt % tungsten, up to 5 wt % rhenium, 6 to 12 wt % tantalum, 4 to 7 wt % aluminum, up to 15 wt % cobalt, up to 0.05 wt % carbon, up to 0.02 wt % boron, up to 0.1 wt % zirconium, up to 0.8 wt % hafnium, up to 2.0 wt % niobium, up to 1.0 wt % vanadium, up to 0.7 wt % titanium, up to 10 wt % of at least one element selected from the group consisting of ruthenium, rhodium, palladium, osmium, iridium, platinum, and mixtures thereof, and the balance essentially nickel. The single crystal nickel base superalloy has a microstructure which is pore-free and eutectic γ–γ' free and which has a gamma prime morphology with a bimodal γ' distribution.

6 Claims, 6 Drawing Sheets

MODIFIED ADVANCED HIGH STRENGTH SINGLE CRYSTAL SUPERALLOY COMPOSITION

CROSS-REFERENCE TO RELATED APPLICATION(S)

This application is a divisional application of U.S. patent application Ser. No. 09/943,150, filed Aug. 30, 2001, entitled MODIFIED ADVANCED HIGH STRENGTH SINGLE CRYSTAL SUPERALLOY COMPOSITION, By Daniel P. DeLuca et al.

BACKGROUND OF THE INVENTION

The present invention relates to an improved single crystal nickel base superalloy having a pore-free, eutectic γ–γ' free microstructure with a modified gamma-prime morphology and to a process for making the improved nickel base superalloy.

Mechanical property tests of cast nickel-base superalloys have shown substantial deleterious effects when conducted in high pressure gaseous hydrogen environments. These effects include reductions in tensile ductility and strength, fatigue and accelerated crack growth rates. Thus, there is a need to develop a nickel base superalloy which avoids these deleterious effects.

SUMMARY OF THE INVENTION

Accordingly, it is an object of the present invention to provide an improved single crystal nickel base superalloy which is pore-free and eutectic γ–γ' free.

It is a further object of the present invention to provide a nickel-base superalloy which has a modified gamma-prime morphology with a bimodal γ' distribution.

It is yet another object of the present invention to provide a method for providing the above improved single crystal nickel base superalloy.

The foregoing objects are attained by the single crystal nickel base superalloy and the process of the present invention.

In accordance with the present invention, a single crystal nickel base superalloy is provided which has a pore free, eutectic γ–γ' free microstructure with a modified gamma prime morphology having a bimodal γ' distribution. The nickel base superalloy has a composition comprising 3.0–12 wt % chromium, up to 3.0 wt % molybdenum, 3.0 to 10 wt % tungsten, up to 5.0 wt % rhenium, 6.0 to 12 wt % tantalum, 4.0 to 7.0 wt % aluminum, up to 15 wt % cobalt, up to 0.05 wt % carbon, up to 0.02 wt % boron, up to 0.1 wt % zirconium, up to 0.8 wt % hafnium, up to 2.0 wt % niobium, up to 1.0 wt % vanadium, up to 0.7 wt % titanium, up to 10 wt % of at least one of ruthenium, palladium, osmium, iridium, platinum, rhodium, and mixtures thereof, and the balance essentially nickel.

A process for producing the nickel base alloy broadly comprises casting an object formed from a single crystal nickel base alloy, subjecting the cast object to hot isostatic processing to close any as-cast microporosity and to provide partial solutioning of any eutectic γ–γ' phase islands, solution heat treating the cast object to fully solution the eutectic γ–γ' phase and to precipitate a uniform distribution of large octet shaped γ' particles and precipitation heat treating the solution treated cast object to form a second and uniform distribution of fine cuboidal γ' particles. By performing the aforementioned process, one achieves the microstructure design of the present invention without incipient melting or recrystallizing the nickel base superalloy during processing.

Other details of the single crystal nickel-base superalloy of the present invention and the process of making same, as well as other objects and advantages attendant thereto, are set forth in the following detailed description and the accompanying drawings.

DETAILED DESCRIPTION OF THE PREFERRED EMBODIMENT(S)

In accordance with the present invention, a cast object, such as a cast turbine component, is formed by casting in single crystal form a nickel base superalloy. The nickel-base superalloy preferably has a composition comprising 3.0 to 12 wt % chromium, up to 3.0 wt % molybdenum, 3.0 to 10 wt % tungsten, up to 5.0 wt % rhenium, 6.0 to 12 wt % tantalum, 4.0 to 7.0 wt % aluminum, up to 15 wt % cobalt, up to 0.05 wt %, carbon, up to 0.02 wt % boron, up to 0.1 wt % zirconium, up to 0.8 wt % hafnium, up to 2.0 wt % niobium, up to 1.0 wt % vanadium, up to 0.7 wt % titanium, up to 10 wt % of at least one element selected from the group consisting of ruthenium, rhodium, palladium, osmium, iridium, platinum, and mixtures thereof, and the balance essentially nickel. The casting step may be carried out using any suitable single crystal casting technique known in the art. For example, the techniques shown in U.S. Pat. Nos. 3,700,023; 3,763,926; 4,190,094; and 4,719,080, which are all incorporated herein by reference, may be utilized.

Figure 1:
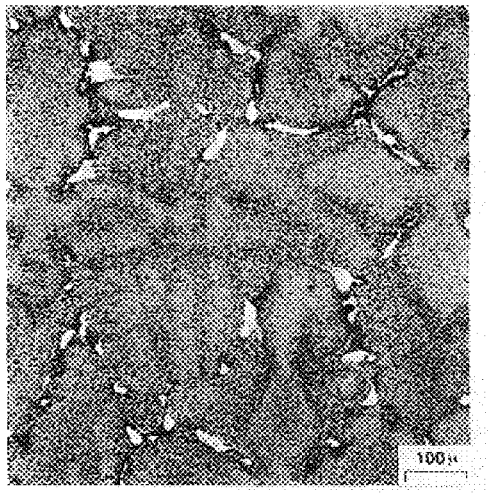
FIG. 1 is a photomicrograph of an as-cast single crystal nickel-base superalloy in accordance with the present invention.
Figure 2:
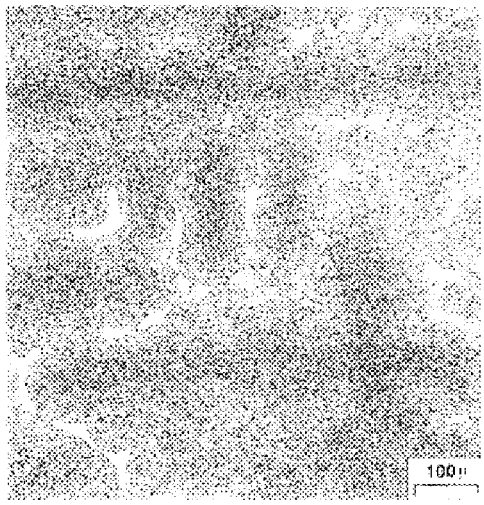
FIG. 2 is a photomicrograph of the nickel-base superalloy of FIG. 1 after it has been subjected to hot isostatic processing in accordance with the present invention.

Following casting, the cast object is subjected to hot isostatic processing to close any as-cast microporosity and to partially solution the eutectic γ–γ' phase islands. The hot isostatic processing may be carried out in any suitable furnace known in the art. An argon or other inert gas atmosphere is provided within the furnace to prevent any environmental interaction between the cast object and the atmosphere. The hot isostatic processing is carried out at a final temperature in the range of from 2145° F. to 2625° F., preferably from 2195° F. to 2565° F., for a time period in the range of from 3.5 hours to 4.5 hours, at a pressure in the range of from 13 ksi to 16.5 ksi, preferably from 14 ksi to 16 ksi, according to the following schedule. The cast object is brought from room temperature, approximately 70° F., to a first temperature in the range of from 2075° F. to 2550° F., preferably from 2115° F. to 2485° F., at a rate of from about 5.4 to 6.6° F./min., preferably from 5.5 to 6.5° F./min. The cast object is then brought from the first temperature to a second temperature in the range of from 2125° F. to 2595° F., preferably from 2170° F. to 2550° F., at a rate of from about 0.4 to 0.6° F./min., preferably from 0.45 to 0.55° F./min. Thereafter, the cast object is brought from the second temperature to a final temperature at a rate of 0.05 to 0.15° F./min. and held at the final temperature for the aforesaid time period. After the time period has elapsed, the cast object is allowed to cool from the final temperature. With regard to the pressure that is applied while the cast object is being heated, the pressure within the furnace is raised from substantially 0 psi to a first pressure in the range of from 4.5 to 5.5 ksi, preferably 4.6 to 5.4 ksi at a rate in the range of 0.01 ksi/min. The pressure is then raised from the first pressure to a final pressure in the range of from about 13.5 ksi to 16.5 ksi, preferably from 14 ksi to 16 ksi, at a rate of about 0.03 ksi/min. The final pressure is then held for a time period of from 2.5 hours to 3.5 hours, preferably 2.75 hours to 3.25 hours, before being relieved. The foregoing schedule is utilized to minimize any potential for recrystallization during the hot isostatic processing. FIGS. 1 and 2 illustrate a typical microstructure as-cast and following the hot isostatic processing step respectively.

Following the hot isostatic processing, the cast object is solution heated treated to fully solution the eutectic γ–γ' phase and to precipitate a uniform distribution of large octet shaped γ' particles which act to impede preferential cracking in the γ matrix phase. During the solution heat treatment, the cast object is taken from room temperature, approximately 70° F., to an initial temperature in the range of from 1625° F. to 2000° F., preferably from 1650° F. to 1950° F., at a temperature ramp rate in the range of from 30° F./min. to 40° F./min., preferably from 33° F./min. to 37° F./min. After reaching the initial temperature, the cast object is taken from the initial temperature to a second temperature in the range of 2075° F. to 2525° F. at a temperature ramp rate in the range of 7.5° F./min. to 9.0° F./min., from the second temperature to a third temperature in the range of from 2100° F. to 2575° F. at a temperature ramp rate in the range of 1.0° F./min. to 2.0° F./min., from the third temperature to a fourth temperature in the range of from 2130° F. to 2600° F. at a temperature ramp rate in the range of from 0.9° F./min. to 1.1° F./min., from the fourth temperature to a fifth temperature in the range of from 2145° F. to 2625° F. at a temperature ramp rate in the range of from 0.4° F./min. to 0.6° F./min., from the fifth temperature to a sixth temperature in the range of from 2150° F. to 2650° F. at a temperature ramp rate in the range of from 0.2° F./min. to 0.4° F./min., and from the sixth temperature to a seventh temperature in the range of from 2190° F. to 2675° F. at a temperature ramp rate in the range of 0.15° F./min. to 0.25° F./min. The cast object is held at the seventh temperature for a time period in the range of 5 hours to 6.5 hours. Thereafter, the temperature of the cast object is dropped from the seventh temperature to an eighth temperature in the range of from 1975° F. to 2425° F. at a cool down rate of 0.9° F./min. to 1.1° F./min. and then from the eighth temperature to room temperature at a minimum cooling rate in the range of from 100° F./min. to 125° F./min. The solution heat treatment described above may be carried out using any suitable furnace or oven known in the art and any suitable atmosphere.

Figure 3:
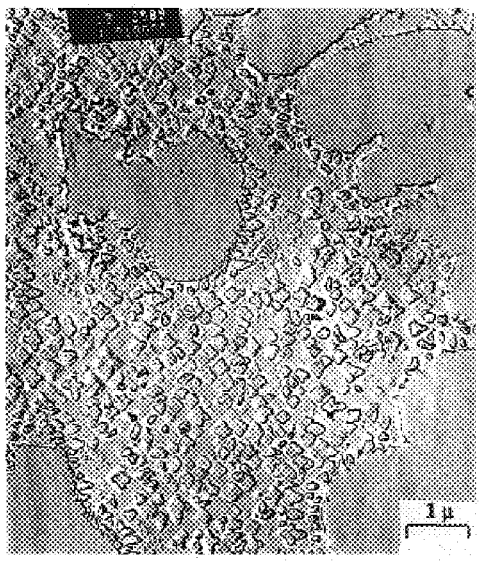
FIG. 3 is a photomicrograph of the nickel-base superalloy of FIG. 2 after it has been subjected to a solution heat treatment in accordance with the present invention.

FIG. 3 illustrates a typical microstructure following a solution heat treatment in accordance with the present invention. The microstructure of the solution treated cast object contains large γ' particles having an average particle size in the range of from 1.0 μ to 20 μ in a continuous gamma matrix. The large γ' particles will occupy from 25 vol % to 50 vol %, preferably from 27 vol % to 45 vol %, of the volume of the cast object. The microstructure of the solution treated cast object will also have γ' arrays, which are coherent and/or non-coherent.

Figure 4:
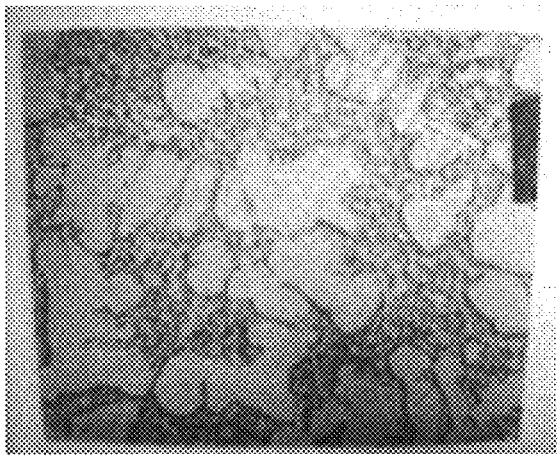
FIG. 4 is a photomicrograph of the nickel-base superalloy of FIG. 3 after it has been subjected to a precipitation heat treatment in accordance with the present invention.

Following the solution heat treatment, the cast object is subjected to a precipitation heat treatment to create a second and uniform distribution of fine cuboidal γ' particles for providing strength. The fine γ' particles have an average particle size in the range of from 0.45 μ to 0.55 μ. The precipitation heat treatment comprises heating the cast object to a treatment temperature in the range of from 1175° F. to 1450° F., preferably from 1200° F. to 1400° F., holding the cast object at the treatment temperature for a time period in the range of from 20 hours to 30 hours, preferably from 22 hours to 26 hours, and then air cooling the cast object. The precipitation heat treatment may be carried out using any suitable furnace/oven known in the art and any suitable atmosphere. FIG. 4 shows a typical microstructure following the precipitation heat treatment. As can be seen from this figure, the single crystal nickel base superalloy cast object has been provided with a microstructure which is pore-free, and eutectic γ–γ' free, and which has a gamma prime morphology with a bimodal γ' distribution.

The single crystal nickel base superalloy of the present invention may be used for turbine blades and vanes in liquid hydrogen fueled rocket propulsion systems. It has many other applications. For example, it can be used to form components for jet engine and industrial turbines such as turbine blades and vanes. It may also be used to make components for pumps.

Figure 5:
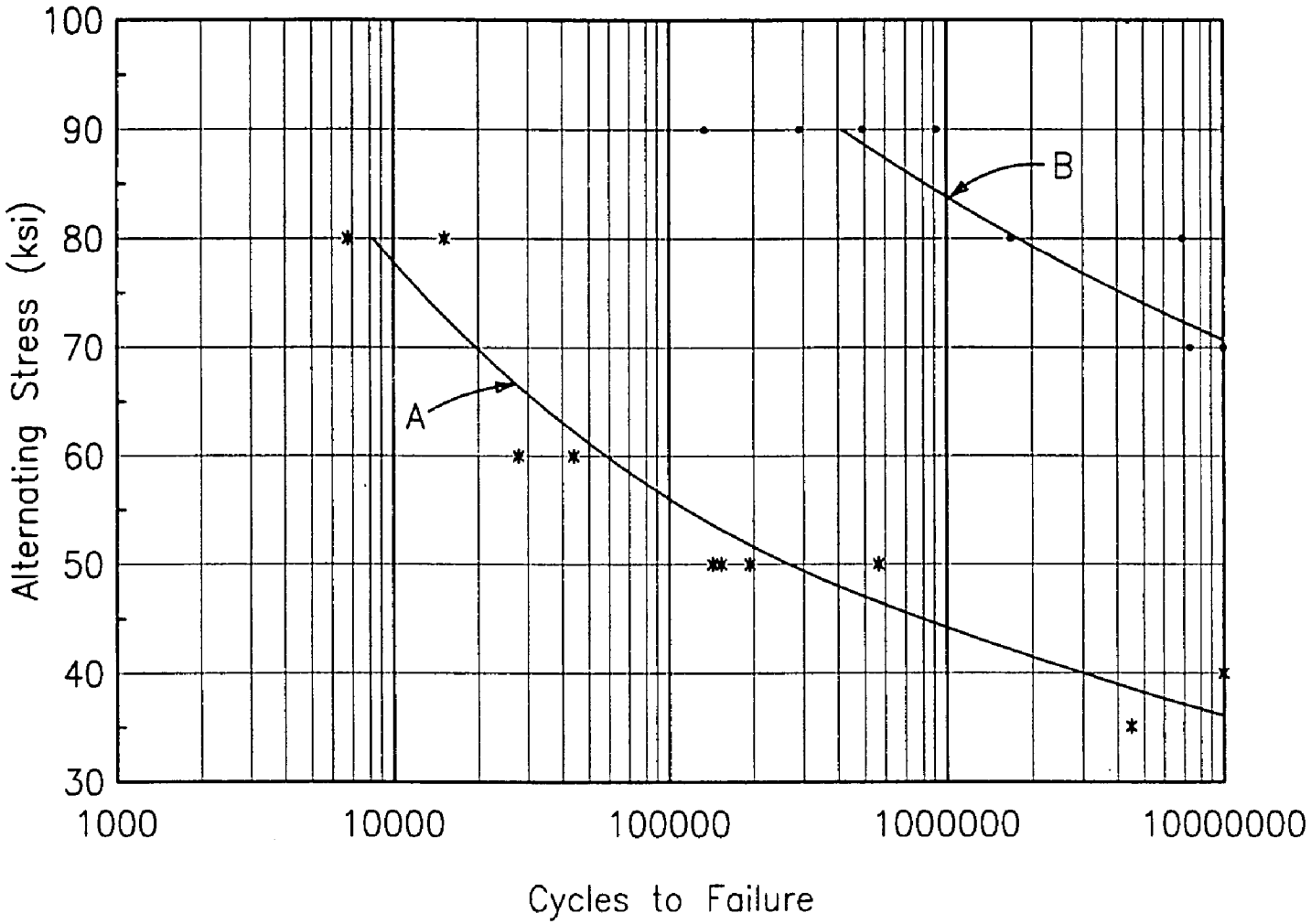
FIG. 5 is a graph showing the results of smooth high cycle fatigue testing in a 34.5 Mpa hydrogen atmosphere at 80° F., r=−1, 20/30 Hz.

The single crystal nickel base alloys of the present invention exhibit significantly better fatigue and crack growth resistance than prior art turbine blade alloys. FIG. 5 illustrates high fatigue cycle life for a prior art nickel base superalloy blade material (Line A) compared to that of the improved single crystal nickel base alloy of the present invention (Line B). High cycle fatigue life for the single crystal nickel base alloy of the present invention is more than 100 times greater than that of the prior art material at an alternating stress of 500 MPa. Mean fatigue strength for the single crystal nickel base alloy of the present invention is 40 ksi higher than the prior art material.

Figure 6:
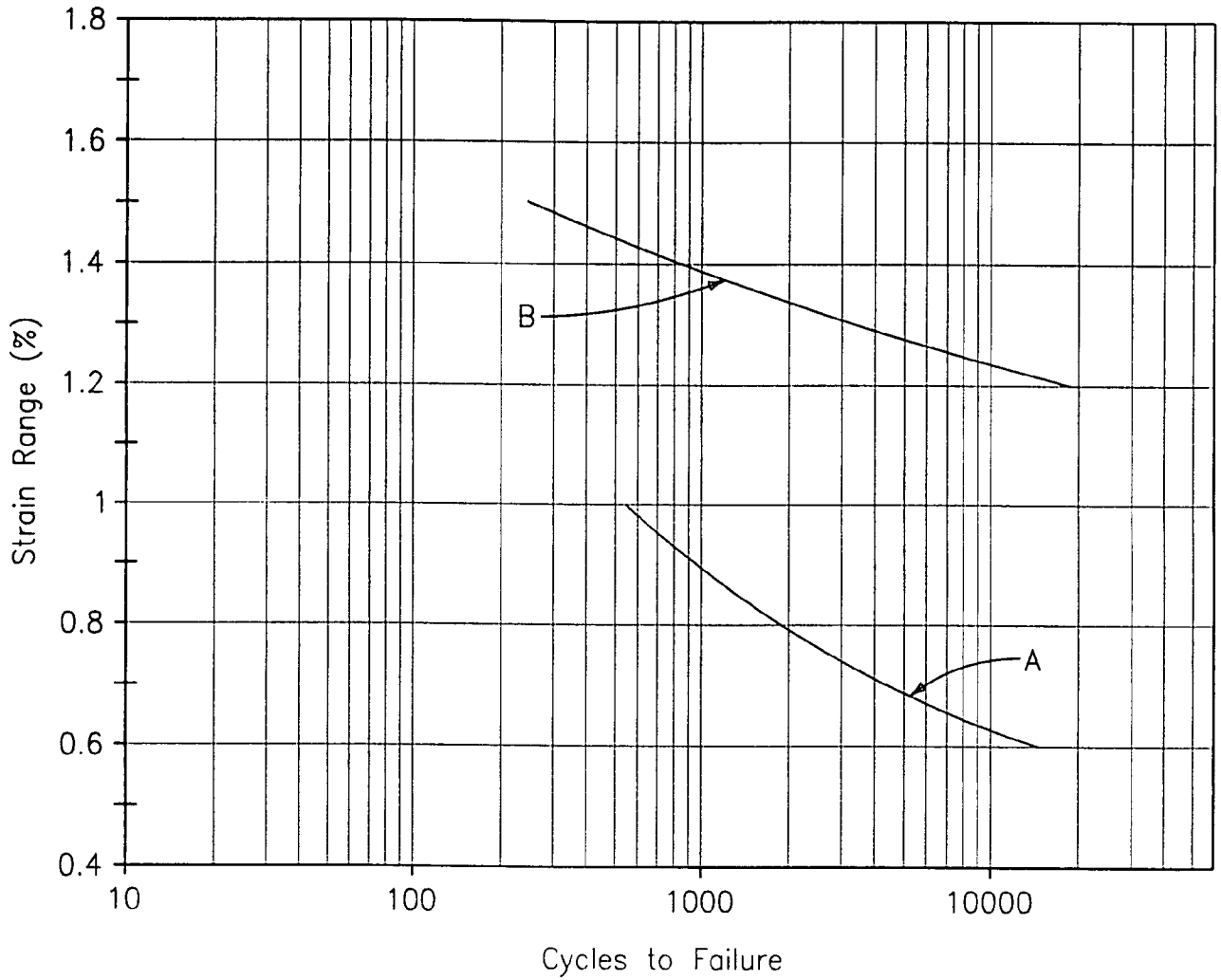
FIG. 6 is a graph illustrating the results of strain control low cycle fatigue testing for smooth specimens tested at 0.167 Hz, 68° F., and R=−1 in 5000 psi hydrogen. A comparison of mean curves for the current invention and the prior art is shown.

FIG. 6 illustrates smooth low cycle fatigue life for a nickel base superalloy prior art blade material (Line A) compared to that of the improved single crystal nickel base superalloy of the present invention (Line B). Low cycle fatigue for the superalloy of the present invention is more than an order of magnitude greater than that of the prior art material.

Figure 7:
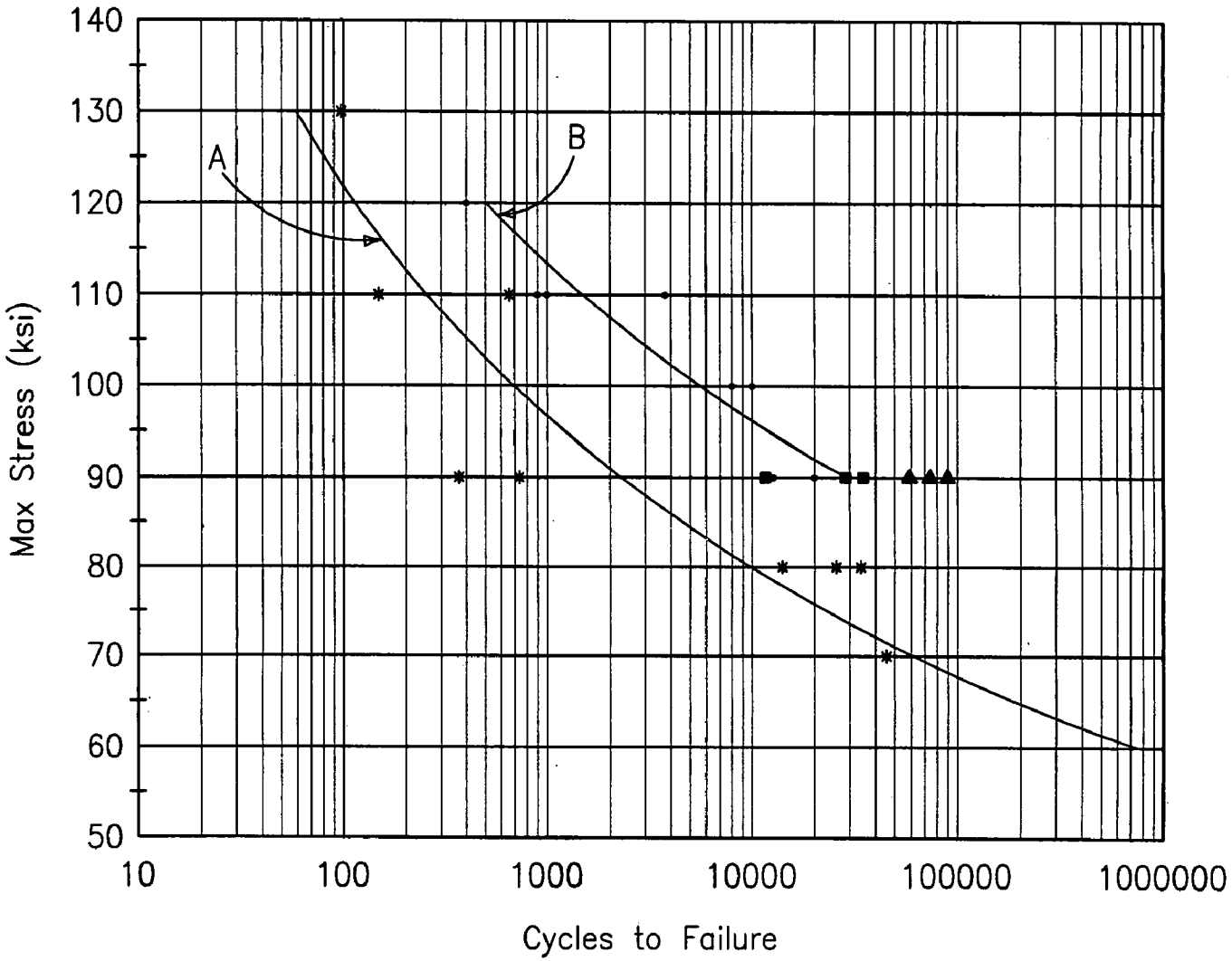
FIG. 7 is a graph illustrating the results of a double notch low cycle fatigue testing in 5000 psi hydrogen at 80° F., R=−0.05, 10/30 cpm, and $K_t$=2.18. A comparison of mean curves for the current invention and prior art is shown.

FIG. 7 illustrates the notched low cycle fatigue life for a prior art nickel base superalloy blade material (Line A) compared to that of the single crystal nickel base superalloy of the present invention (Line B). Notched low cycle fatigue life for the nickel base superalloy of the present invention ranges from 3 to 10 times greater than that of the prior art material.

Figure 8:
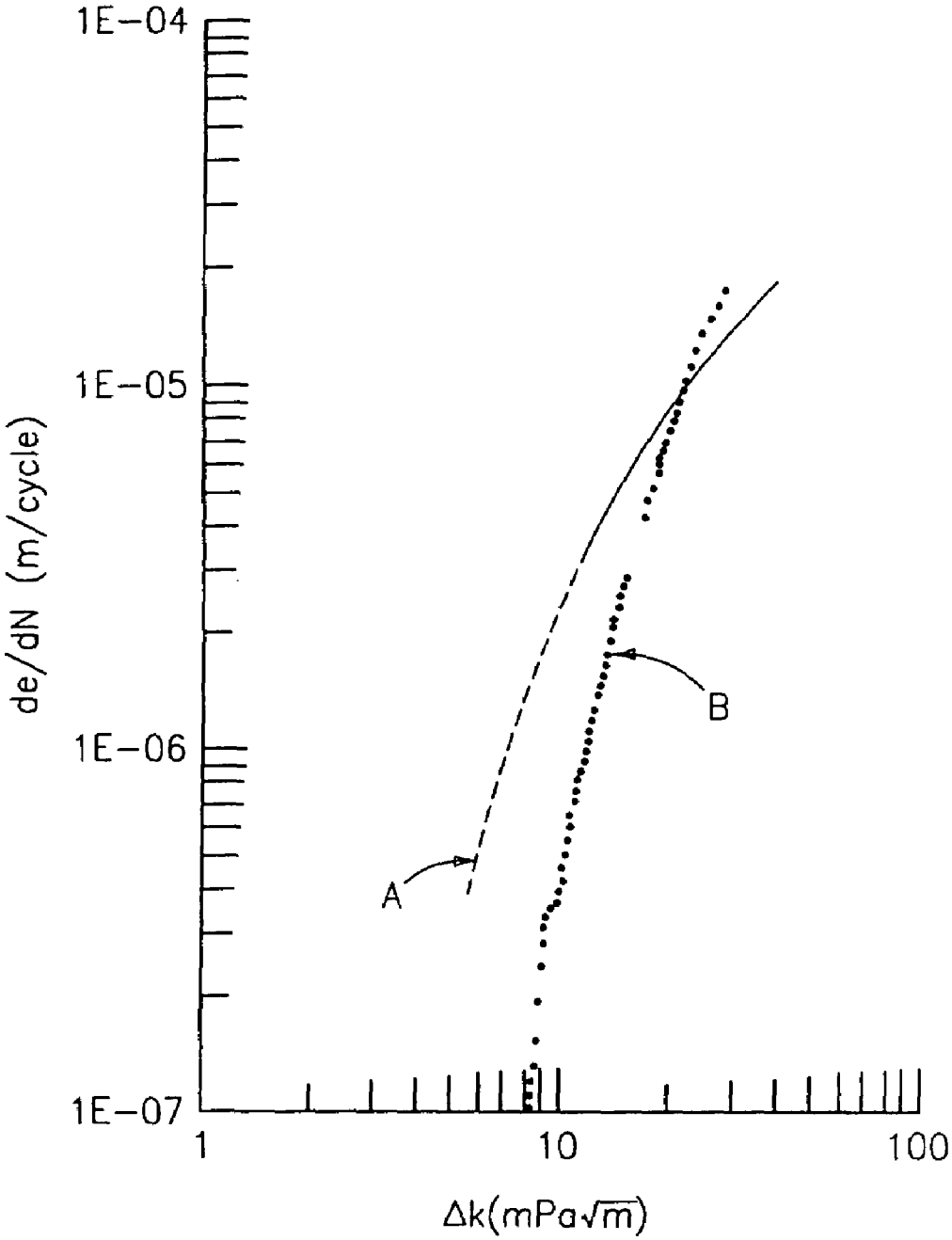
FIG. 8 is a graph illustrating fatigue crack growth rates for the superalloy in accordance with the present invention and for a prior art nickel base superalloy.

FIG. 8 is a graph illustrating the fatigue crack growth rates for a prior art nickel base superalloy blade material (Line A)

compared to that of the single crystal nickel base superalloy of the present invention (Line B). Fracture resistance of the superalloy of the present invention is significantly better in the critical near threshold region of the fatigue crack growth curve than that of the prior art material.

It is apparent that there has been provided in accordance with the present invention an improved nickel base superalloy and a process for forming same which fully satisfies the objects, means, and advantages set forth hereinbefore. While the present invention has been described in the context of specific embodiments thereof, other alternatives, modifications, and variations will become apparent to those skilled in the art having read the foregoing description. Accordingly, it is intended to embrace those alternatives, modifications, and

What is claimed is:

1. A process for forming an improved nickel base superalloy comprising the steps of:

casting an object formed from a single crystal nickel base superalloy having a microstructure;

closing any as-cast microporosity and partially solutioning eutectic γ–γ' phase islands in the microstructure of said single crystal nickel base superalloy;

fully solutioning any eutectic γ–γ' phase and precipitating a uniform distribution of large γ' particles in the microstructure;

forming fine γ' particles in the microstructure to improve the strength of the nickel base superalloy;

said closing and partially solutioning step comprising subjecting said cast object to hot isostatic processing at a final temperature in the range of from 2145° F. to 2625° F. for a time period in the range of from 3.5 to 4.5 hours at a final pressure in the range of from 13 ksi to 16.5 ksi; and wherein said hot isostatic processing step further comprises bringing the cast object from room temperature to a first temperature in the range of from 2075° F. to 2550° F. at a rate of from about 5.4 to 6.6° F./min, from the first temperature to a second temperature in the range of from 2125° F. to 2595° F. at a rate of from 0.4 to 0.6° F./min, and from the second temperature to the final temperature at a rate of 0.05° F./min to 0.15° F./min.

2. A process according to claim 1, wherein said casting step comprises casting a single crystal nickel base superalloy having a composition comprising 3.0 to 12 wt % chromium, up to 3.0 wt % molybdenum, 3.0 to 10 wt % tungsten, up to 5.0 wt % rhenium, 6.0 to 12 wt % tantalum, 4.0 to 7.0 wt % aluminum, up to 15 wt % cobalt, up to 0.05 wt % carbon, up to 0.02 wt % boron, up to 0.1 wt % zirconium, up to 0.8 wt % hafnium, up to 2.0 wt % niobium, up to 1.0 wt % vanadium, up to 0.7 wt % titanium, up to 10 wt % of at least one element selected from the group consisting of ruthenium, rhodium, palladium, osmium, iridium, platinum, and mixtures thereof, and the balance essentially nickel.

3. A process for forming an improved nickel base superalloy comprising the steps of:

casting an object formed from a single crystal nickel base superalloy having a microstructure;

closing any as-cast microporosity and partially solutioning eutectic γ–γ' phase islands in the microstructure of said single crystal nickel base superalloy;

fully solutioning any eutectic γ–γ' phase and precipitating a uniform distribution of large γ' particles in the microstructure;

forming fine γ' particles in the microstructure to improve the strength of the nickel base superalloy;

said closing and partially solutioning step comprising subjecting said cast object to hot isostatic processing at a final temperature in the range of from 2145° F. to 2625° F. for a time period in the range of from 3.5 to 4.5 hours at a final pressure in the range of from 13 ksi to 16.5 ksi; and wherein said hot isostatic processing step further comprises bringing the cast object from room temperature to a first temperature in the range of from 2115° F. to 2485° F. at a rate of from about 5.5 to 6.5° F./min, from the first temperature to a second temperature in the range of from 2170° F. to 2550° F. at a rate of from 0.45 to 0.55° F./min, and from the second temperature to the final temperature.

4. A process for forming an improved nickel base superalloy comprising the steps of:

casting an object formed from a single crystal nickel base superalloy having a microstructure;

closing any as-cast microporosity and partially solutioning eutectic γ–γ' phase islands in the microstructure of said single crystal nickel base superalloy;

fully solutioning any eutectic γ–γ' phase and precipitating a uniform distribution of large γ' particles in the microstructure;

forming fine γ' particles in the microstructure to improve the strength of the nickel base superalloy;

said closing and partially solutioning step comprising subjecting said cast object to hot isostatic processing at a final temperature in the range of from 2145° F. to 2625° F. for a time period in the range of from 3.5 to 4.5 hours at a final pressure in the range of from 13 ksi to 16.5 ksi; and wherein said hot isostatic processing step further comprises raising the pressure from substantially 0 psi to a first pressure in the range of from 4.5 to 5.5 ksi at a rate in the range of 0.01 ksi/min and then raising the pressure from the first pressure to the final pressure at a rate in the range of 0.03 ksi/min. and holding the final pressure for a time period in the range of from 2.5 hours to 3.5 hours.

5. A process for forming an improved nickel base superalloy comprising the steps of:

casting an object formed from a single crystal nickel base superalloy having a microstructure;

closing any as-cast microporosity and partially solutioning eutectic γ–γ' phase islands in the microstructure of said single crystal nickel base superalloy;

fully solutioning any eutectic γ–γ' phase and precipitating a uniform distribution of large γ' particles in the microstructure;

forming fine γ' particles in the microstructure to improve the strength of the nickel base superalloy;

said fully solutioning and precipitating step comprises subjecting the cast object to a solution heat treatment step; and wherein said solution heat treating step comprises bringing the cast object from room temperature to an initial temperature in the range of from 1625° F. to 2000° F. at a temperature ramp rate in the range of from 30° F./min. to 40° F./min., taking the cast object from the initial temperature to a second temperature in the range of from 2075° F. to 2525° F. at a temperature ramp rate in the range of 7.5° F./min. to 9.0° F./min., taking the cast object from the second temperature to a third temperature in the range of from 2100° F. to 2575° F. at a temperature ramp rate in the range of 1.0° F./min. to 2.0° F./min., taking the cast object from the third temperature to a fourth temperature in the range of from 2130° F. to 2600° F. at a temperature ramp rate in the range of 0.9° F./min. to 1.1° F./min., taking the cast object from the fourth temperature to a fifth temperature in the range of 2145° F. to 2625° F. at a temperature ramp rate in the range of from 0.4° F./min. to 0.6° F./min., taking the cast object from the fifth temperature to a sixth temperature in the range of from 2150° F. to 2650° F. at a temperature ramp rate in the range of from 0.2° F./min. to 0.4° F./min., and taking the cast object from the sixth temperature to a seventh temperature in the range of from 2190° F. to 2675° F. at a temperature ramp rate in the range of 0.15° F./min. to 0.25° F./min.

6. A process according to claim 5, wherein the solution heat treating step further comprises holding the cast object at said seventh temperature for a time period in the range of 5 hours to 6.5 hours, decreasing the temperature of said cast object from said seventh temperature to an eighth temperature in the range of from 1975° F. to 2425° F. at a cool down rate of 0.9° F./min. to 1.1 F/min., and decreasing the temperature of said cast object from said eighth temperature to room temperature at a minimum cooling rate in the range of from 100° F./min. to 125° F./min.

* * * * *